US006082012A

United States Patent [19]

McLeod

[11] Patent Number: 6,082,012

[45] Date of Patent: Jul. 4, 2000

[54] BOW SIGHTS

[76] Inventor: Mark C. McLeod, 10169 Lynch La., Bastrop, La. 71220

[21] Appl. No.: 08/998,190

[22] Filed: Dec. 24, 1997

[51] Int. Cl.[7] ..... F41G 1/467

[52] U.S. Cl. ..... 33/265; 33/241; 124/87

[58] Field of Search ..... 33/265, 241, 242, 33/243; 124/87

[56] References Cited

U.S. PATENT DOCUMENTS

| | | | |
|---|---|---|---|
| 4,417,403 | 11/1983 | Strange | 33/265 |
| 5,025,565 | 6/1991 | Stenerson | 33/265 |
| 5,050,576 | 9/1991 | Larson | 33/265 |
| 5,253,423 | 10/1993 | Sullivan, Jr. | 33/265 |
| 5,339,227 | 8/1994 | Jones | 362/109 |
| 5,341,791 | 8/1994 | Shafer | 124/87 |
| 5,379,747 | 1/1995 | Morris | 124/87 |
| 5,524,351 | 6/1996 | Pinson et al. | 33/265 |
| 5,819,423 | 10/1998 | Kamola | 33/265 |

*Primary Examiner*—Christopher W. Fulton
*Attorney, Agent, or Firm*—John M. Harrison

[57] ABSTRACT

Pendulum and fixed bow sights which are fitted with sight rings having monofilament crosshairs and optionally provided with a source of black light for illuminating the crosshairs under conditions of low lighting. The pendulum bow sight is mounted to a bow in pivoting fashion, facilitating sighting of the target in a direct line of sight regardless of the elevation of the hunter. The sight ring in the pendulum bow sight is mounted on a pendulum bracket which is pivotally and adjustably attached to a frame mounted on the bow. The pendulum bracket and thus, the sight ring, may be stabilized by operation of a stabilizing pin and supported in a limited pivoting configuration with respect to the frame, by means of a pendulum bracket support. The fixed bow sight is mounted in fixed relationship on the bow.

23 Claims, 3 Drawing Sheets

BOW SIGHTS

BACKGROUND OF THE INVENTION

1. Field of the Invention

This invention relates to archery bow sights and more particularly, to pendulum and fixed bow sights which utilize a sight ring strung with monofilament line to define perpendicular crosshairs and having an optional black light for illuminating the monofilament crosshairs in conditions of low light, such as early morning and late evening. The fixed bow sights mount directly to the frame of the bow in fixed relationship with respect to the bow, while the pendulum bow sight is characterized by a pendulum bracket pivotally and adjustably attached to a mount plate connected to the bow. The pendulum bracket mounts the sight ring. Accordingly, when the pendulum bow sight is used, the hunter's line of sight extends through the sight ring when aiming the bow at any bow elevation. The pendulum bow sight further includes an adjustable stabilizing pin for fixing the pendulum bracket, and thus the sight ring, with respect to the bow and the frame and an adjustable pendulum bracket support extends from the mount plate for supporting the pendulum bracket at a selected sight ring attitude in limited pivoting configuration. The black light may be mounted in any desired position on the frame of the bow, one or more brackets or guards extending from the bar frame, the pendulum bracket, the sight ring or in any other desired location which allows the black light to be focused on the crosshairs.

2. Description of the Prior Art

Many different variations of bow sights are known in the art. Typical of these is the bow sight detailed by R. L. Strange in U.S. Pat. No. 4,417,403, dated Nov. 29, 1983. The bow sight includes a bow bracket which is adjustably attached to the bow and a planar sight bracket adjustably attached to the bow bracket in a vertical plane. A front sight is mounted at one end of the sight bracket and extends horizontally from the sight bracket. A distance member is disposed generally parallel to and adjacent to the sight bracket and is pivotally mounted thereto about a horizontal axis perpendicular to the plane of the sight bracket. A rear sight is mounted to the distance member and extends horizontally away from the distant member and range indicia are located on the sight bracket. A reference mark is located on the distance member. U.S. Pat. No. 5,025,565, dated Jun. 25, 1991, to Stenerson et al, details a "Range Finding Bow Sight". The sight has two sets of crosshairs, one in the front and one in the rear, which crosshairs create positive vertical and horizontal alignment. The distance between the front and rear crosshairs is adjustable. U.S. Pat. No. 5,253,423, dated Oct. 19, 1993, details a "Crosshair Pendulum Bow Sight", which includes a sight housing having spaced, parallel outer and vertical sides, one of which includes apparatus for mounting the sight housing when the handle is positioned such that the vertical sides are substantially coplanar with the longitudinal axis of the handle. A sighting element is pivotally mounted by bearings provided in sidewalls of the housing, such that the sighting element is pivotable relative to the handle. A sighting opening is formed in the sighting element, which includes traversing vertical and horizontal crosshairs. U.S. Pat. No. 5,339,227, dated Aug. 16, 1994, details an "Illuminator For Archery Aiming Scope". The illuminating device uses a focus-concentrated light beam to illuminate both the aiming mark and the level of the scope. The preferred light source is a high brightness focus, light-emitting diode which is mounted to project a narrow beam of light onto the aiming mark from a position above and outside the field of view of the scope. The illumination of the level is achieved by multiple reflections of the light beam between the lens and the level, such that the bubble of the level brightens when the bow is in the desired vertical orientation. U.S. Pat. No. 5,341,791, dated Aug. 30, 1994, to Schaeffer, details a "Bow Sight Apparatus". The apparatus includes an illuminated sighting structure having a sighting tube arranged for mounting relative to an archery bow. The sighting tube includes a first end spaced from the second end, the second end having a chemiluminescent ring, with a chemiluminescent sphere mounted within a rod directed into the sighting tube adjacent to the first end. U.S. Pat. No. 5,379,747, dated Jan. 10, 1995, to Morris, et al, details an "Archery Bow Sight" having a relatively large sight window to facilitate better target alignment.

Other types of bow sights have been developed in attempts to solve sighting problems. The majority of the light-weight bow sights use a string-mounted peep sight for the rear sight. These sights are accurate, but have the serious disadvantage of loss of light that occurs when sighting through a small aperture. A most common front sight is the pin-type, which requires that the archer judge the range of the target and, if shooting from a position elevated above ground level, such as a tree stand, compensate for change in arrow trajectory due to shooting downwardly at various angles. Shooting an arrow accurately from a traditional recurve or compound bow at a target such as a deer or target requires a relatively precision sighting device. The archer must judge range and shooting angle when shooting from an elevated position and adjust for the trajectory of the arrow under these conditions. Compounding the sighting problem for the game hunting archer is the frequent need to shoot very quickly in low light conditions and possibly in inclimate weather. The bow hunter must sometimes also traverse rugged landscape, often in the dark, or climb into stands or trees, necessitating that a sighting device be simple, light and able to endure the rigors of daily rough use. Sometimes the bow hunter does not have time for precision sight alignment and must quickly and instinctively release an arrow while subconsciously using some portion of the bow arrow or sight as a point of reference.

Accordingly, it is an object of this invention to provide new and improved bow sights which are characterized by sturdy, rugged, relatively large sight rings, either fixed, or pivotally mounted to the bow in pendulum fashion, and fitted with bright crosshairs which may be illuminated by an optional black light for viewing the crosshairs and aiming the bow in conditions of low light.

Another object of this invention is to provide bow sights which may either be fixed or pivotally attached to a compound or recurve bow and include large sight windows optionally fitted with target reference marks and preferably fluorescent monofilament crosshairs that may be optionally illuminated by a black light under conditions of low light, such as the early morning and late evening, to extend hunting time.

Still another object of this invention is to provide a pendulum bow sight which includes a round sight ring having fluorescent crosshairs and mounted on a sight pendulum pivotally attached to a pendulum bracket connected to the bow, such that the line of sight of the hunter may be directed through the opening in the sight ring as the sight ring remains substantially vertically oriented, responsive to pivoting of the sight pendulum with respect to the connecting mount plate.

Still another object of the invention is to provide a pendulum bow sight for attachment to a compound or recurve bow, which pendulum bow sight is characterized by a round sight ring fitted with target reference marks and fluorescent monofilament crosshairs of selected color and optionally, with a black light for illuminating the colored crosshairs in low light conditions, such as early morning and late evening. The sight ring is fixed to a sight pendulum pivotally and adjustably attached to a mount plate connected to the bow frame and fitted with a stabilizing pin and a pendulum bracket support for limiting the travel of the sight pendulum and the sight ring with respect to the mount plate.

SUMMARY OF THE INVENTION

These and other objects of the invention are provided in bow sights, the fixed version of which mounts directly to the frame of a bow in fixed relationship with respect to the frame and is characterized by a relatively large sight ring fitted with optional target reference marks, monofilament crosshairs of selected, typically bright, fluorescent, color and an optional black light source for illuminating the crosshairs in conditions of low light, such as early morning and late evening, to extend hunting time. In another embodiment of the invention a pendulum bow sight is provided and includes a large sight ring also provided with optional target reference marks and fluorescent monofilament crosshairs optionally illuminated by a black light source, which sight ring is mounted on a sight pendulum pivotally and adjustably attached to a mount plate connected to the bow frame. The sight ring is so mounted as to facilitate horizontal orientation of the sight ring regardless of the elevation of the bow and the hunter. Stabilizing and bracket support pins are also extended from the mount plate for optional engagement with the sight pendulum to respectively stabilize and support the sight pendulum and sight ring in any desired position. A sight guard may be attached to the mount plate and extended around the pendulum bow sight for protecting the pendulum bow sight and optionally mounting a black light source.

BRIEF DESCRIPTION OF THE DRAWINGS

The invention will be better understood by reference to the accompany drawings, wherein.

DESCRIPTION OF THE PREFERRED EMBODIMENTS

Figures 1, 2, 3:
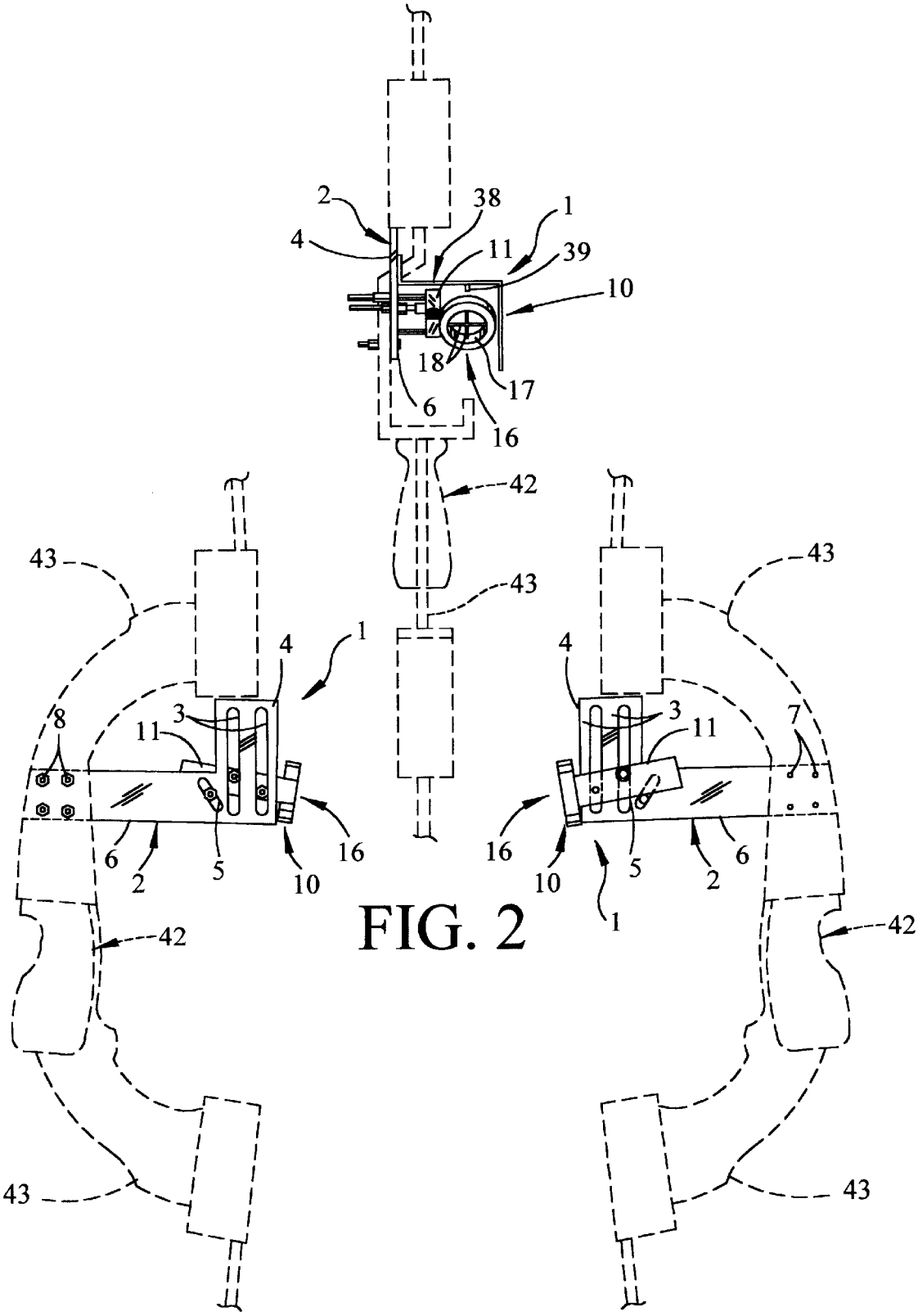
FIG. 1 is a left side view of the pendulum bow sight embodiment of this invention mounted in functional position on a bow.
FIG. 2 is a front view of the pendulum bow sight and bow illustrated in FIG. 1, with an optional sight guard for protecting the pendulum bow sight and mounting a source of black light.
FIG. 3 is a right side view of the pendulum bow sight and bow illustrated in FIGS. 1 and 2.
Figure 4:
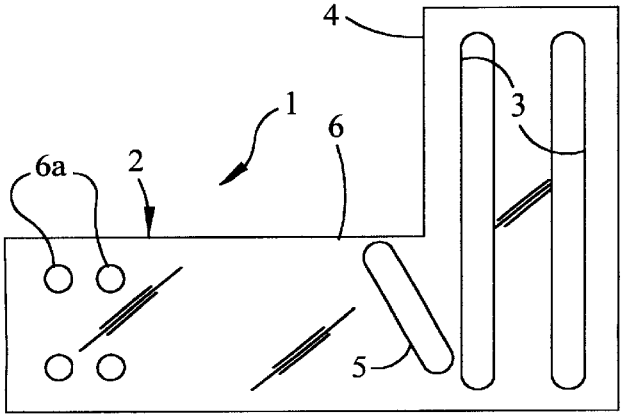
FIG. 4 is a side view of a preferred mount plate for fixed attachment to the frame of a bow and mounting the sight pendulum and sight ring elements of the pendulum bow sight illustrated in FIGS. 1–3.
Figure 5:
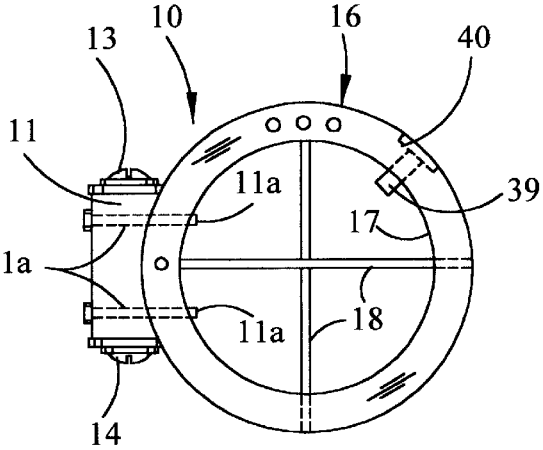
FIG. 5 is a front view of the sight ring and sight pendulum elements of the pendulum bow sight illustrated in FIGS. 1–3.
Figure 6:
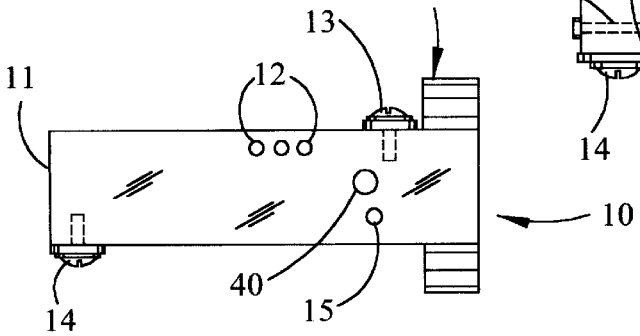
FIG. 6 is a top view of the sight ring and sight pendulum elements illustrated in FIG. 5.
Figure 8:
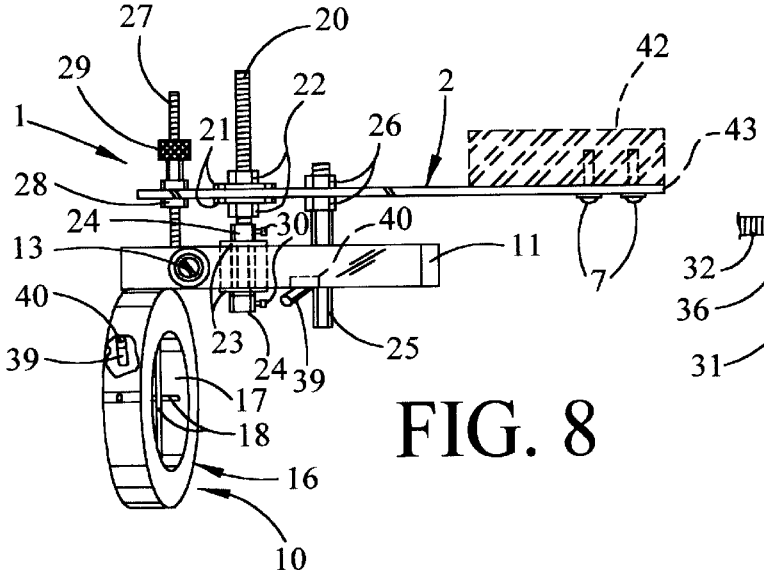
FIG. 8 is a top view of the pendulum bow sight illustrated in FIGS. 1–3.

Referring initially to FIGS. 1–6, 8 and 9 of the drawings, in a first preferred embodiment of the invention a pendulum bow sight is generally illustrated by reference numeral 1. The pendulum bow sight 1 includes an L-shaped mount plate 2, characterized by parallel pendulum mount slots 3, provided in a pendulum mount leg 4 and extending into the bow mount leg 6 of the mount plate 2, as illustrated in FIG. 4. A support pin slot 5 is also provided in the bow mount leg 6 in angular relationship with respect to the typically parallel pendulum mount slots 3. Mount leg openings **6*a* are provided in spaced relationship with respect to each other in the extending end of the bow mount leg 6, as further illustrated in FIG. 4 to accommodate bow mount bolts 7 (FIGS. 3 and 9) for fixedly attaching the bow mount leg 6 of the mount plate 2 to the bow arm 43 of a bow 42 (illustrated in phantom). It will be appreciated by those skilled in the art that the bow 42 may be either a compound bow or a recurve bow, as desired, although the pendulum bow sight 1 is primarily designed for use with compound bows. The bow mount bolts 7 may be threaded into existing drilled and tapped openings (not illustrated) provided in the bow frame 43 of the bow 42, or the mount plate 2 may be secured in place by threading mount nuts 8 on the bow mount bolts 7, as illustrated in FIG. 1. A sight pendulum 10 includes a pendulum bracket 11, fitted with pendulum adjusting openings 12, as illustrated in FIG. 6 and adjustably and pivotally connected to the mount plate 2 at a pendulum mount slot 3, by means of a threaded pendulum pivot pin 20, plate washers 21 and pivot pin nuts 22, as illustrated in FIG. 8. Bracket washers 23 and bracket collars 24, fitted with allen screws 30, typically serve to attach the pendulum bracket 11 to the threaded pendulum pivot pin 20, as further illustrated in FIG. 8. A bushing (not illustrated) may be provided on the pendulum pivot pin 20 at the pendulum mount slot 3 in pendulum bracket 11, if desired. Accordingly, it will be appreciated from a consideration of FIGS. 8 and 9 that the pendulum bracket 11 is pivotally mounted with respect to the mount plate 2 and is spaced from the mount plate 2, as particularly illustrated in FIG. 8**.

Figure 9:
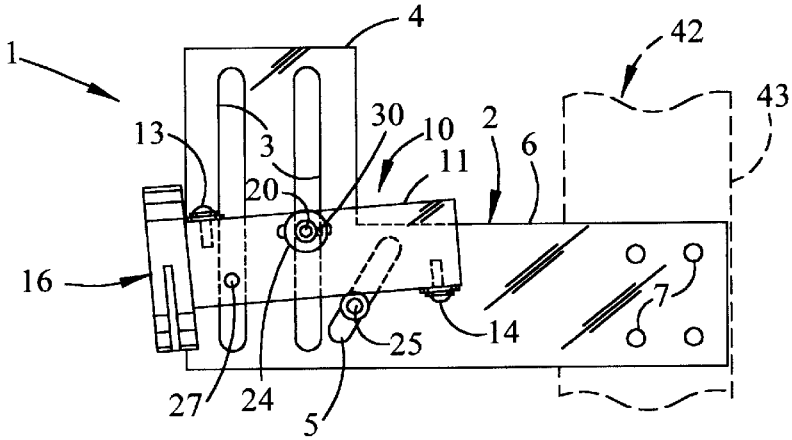
FIG. 9 is a side view of the pendulum bow sight illustrated in FIG. 8.
Figure 11:
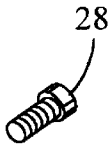
FIG. 11 is a perspective view of a typical stabilizing pin mount for mounting the stabilizing pin in the mount plate illustrated in FIG. 10.

A sight ring 16 is fixedly attached to one end of the pendulum bracket 11 by means of ring bolts **11*a*, as illustrated in FIG. 5, and the sight ring 16 is preferably circular in configuration and is fitted with typically blue or yellow fluorescent monofilament crosshairs 18, extending across the diameter of the ring aperture 17 of the sight ring 16 in crossed relationship, as further illustrated in FIG. 5. As illustrated in FIG. 6 of the drawings, a top counterweight bolt 13 is threaded into the top pendulum bracket 11 adjacent to the sight ring 16 and a bottom counterweight bolt 14 is threaded into the bottom of the opposite end of the pendulum bracket 11 for balancing the pendulum bracket 11, as hereinafter further described. A stabilizing pin seat 15 is drilled or otherwise provided in the side of the pendulum bracket 11 facing the mount plate 2, for selectively receiving one end of a threaded stabilizing pin 27, adjustably attached to the mount plate 2 at the front one of the pendulum mount slots 3 by means of a stabilizing pin mount 28 and a knurled mount nut 29, as illustrated in FIGS. 8, 9 and 11. Accordingly, the pivoting function of the sight pendulum 10 with respect to the mount plate 2 and the bow 42 may be arrested and stabilized by threading the stabilizing pin 27 through the internally-threaded stabilizing pin mount 28 after loosening the mount nut 29 on the stabilizing pin mount 28, such that the extending end of the stabilizing pin 27 projects into the stabilizing pin seat 15, illustrated in FIG. 6, provided in the pendulum bracket 11**.

As illustrated in FIG. 2 of the drawings, a sight guard 38 may be bolted or otherwise attached to the mount plate 2 and extended over and at least partially around the pendulum bow sight 1 for protection of the pendulum bow sight 1. A black light source 39 can also be mounted on the sight guard 38 and fitted with a battery 40 and associated wiring (not illustrated) to facilitate focusing the black light source 39 on the crosshairs 18 in the sight ring 16.

Figure 12:
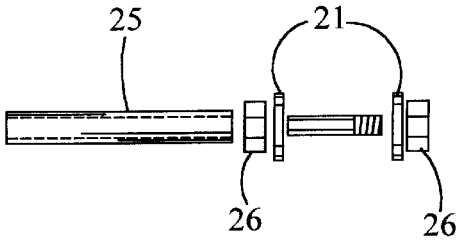
FIG. 12 is an exploded view of a typical pin bracket support element attached to the mount plate illustrated in FIG. 4 for supporting the sight pendulum under certain conditions of use of the pendulum bow sight illustrated in FIGS. 1–3, 8 and 9.

Referring again to FIGS. 8, 9 and 12 of the drawings, a pendulum bracket support 25 is also typically adjustably attached to the mount plate 2 in the support pin slot 5 by means of support pin nuts 26 and corresponding optional plate washers 21. The function of the pendulum bracket support 25 is to support the pendulum bracket 11, such that the sight pendulum 10 pivots to a desired limited extent on the pendulum pivot pin 20, as further hereinafter described.

Figure 7:
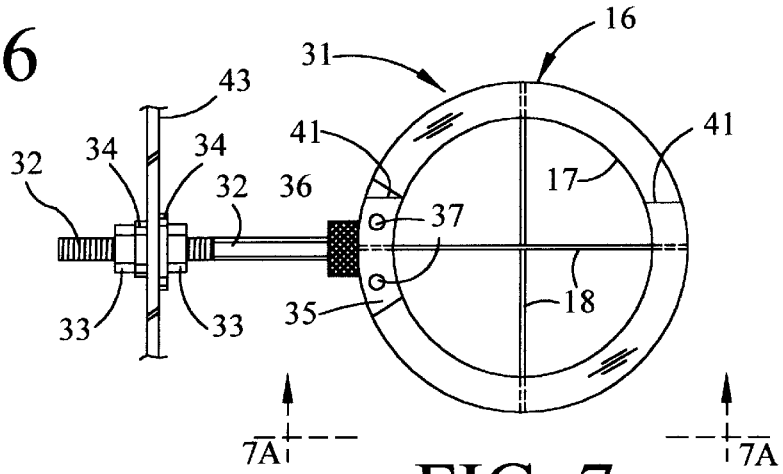
FIG. 7 is a front view of a fixed bow sight embodiment of the invention.
Figure 7A:
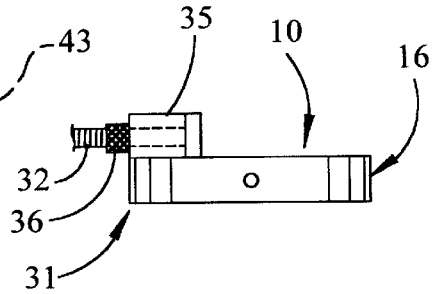
FIG. 7A is a top view of the sight ring element of the fixed bow sight illustrated in FIG. 7.
Figure 10:
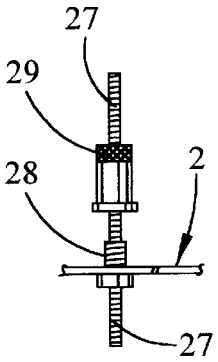
FIG. 10 is a top view of a typical stabilizing pin assembly for mounting on the mount plate illustrated in FIG. 2 and engaging the sight pendulum element of the pendulum bow sight illustrated in FIGS. 1–3, 8 and 9.

Referring now to FIGS. 7 and 7A of the drawings, in another preferred embodiment of the invention a fixed bow sight 31 is illustrated. The fixed bow sight 31 includes a sight ring 16, designed substantially in the same manner as the sight ring 16 provided in the pendulum bow sight 1, and also fitted with target reference marks 41, spaced from the horizontal ones of the diametric, crossed monofilament crosshairs 18. The sight ring 16 is mounted on a sight ring mount pin 32, the opposite end of which is typically attached to the bow frame 43 by means of mount pin nuts 33 and corresponding mount pin washers 34. In a preferred embodiment the sight ring mount pin 32 is connected to a mount pin seat 35, which is attached to the sight rings 16 by means of seat mount screws 37 and the sight ring mount pin 32 is threadably secured thereon by means of a knurled seat nut 36.

Referring now to FIGS. 5, 6 and 8 of the drawings, in a most preferred embodiment of the invention a black light source 39, typically powered by a battery 40, is typically seated in the sight ring 16 (FIGS. 5 and 8) or in the pendulum bracket 11 (FIG. 6) for illuminating the monofilament crosshairs 18 in conditions of low light, such as early morning and late evening, to prolong hunting time. Alternatively, the black light source 39 and battery 40 can be mounted on the sight guard 38, as illustrated in FIG. 2 and heretofore described. The black light source 39 may be of any desired design well known to those skilled in the art, emitting a beam of invisible ultraviolet or infrared light, and it has surprisingly been found that subjecting the diametric fluorescent monofilament crosshairs 18, which may be of any desired fluorescent color such as yellow, blue or the like, to the beam of black light, effects a luminous glow along the crossed axis of the crosshairs 18 and thus facilitates surprisingly good sighting conditions in the conditions of low light. Although the black light source 39 and wafer battery 40 are illustrated as mounted in the sight ring 16 and pendulum bracket 11, it will be appreciated that these elements may be mounted in any desired location, including on the bow 42 itself or on any bow accessory element such as a bracket plate or the like, as heretofore described, for focusing the black light beam in the fluorescent monofilament crosshairs 18.

In operation, the pendulum bow sight 1 of this invention is utilized as follows. The mount plate 2 of the pendulum bow sight 1 is threaded to the bow frame 43 of the bow 42 using the bow mount bolts 7 as illustrated in FIG. 8, or the bow mount bolts 7 may be used in combination with the corresponding mount nuts 8, as illustrated in FIGS. 1 and 3 of the drawings. The pendulum bracket 11 of the sight pendulum 10 is then pivotally attached to the inside pendulum mount slot of the mount plate 2 using the pivot mount nuts 22, as described above, such that the pendulum bracket 11 pivots on the pendulum pivot pin 20 and facilitates sighting through the sight ring 16 toward a target. The line of sight can be quickly and easily effected regardless of the elevation of the bow and the hunter due to the pivoting function of the sight pendulum 10 of the pendulum bow sight 1, wherein the sight ring 16 always maintains a horizotal alignment, regardless of the relative position of the bow 42. However, under circumstances where it is desired to fix the sight ring 16 in position with respect to the bow 42, the stabilizing pin 27 can be adjustably inserted in the corresponding stabilizing pin seat 15 of the pendulum bracket 11, responsive to loosening of the mount nut 29 on the corresponding stabilizing pin mount 28, as heretofore described. The sight pendulum 10 is now fixed with respect to the bow 42 and sighting can be accomplished without pivoting of the sight pendulum 10.

The pendulum bracket support 25 can also be utilized under circumstances where it is desired to facilitate pivoting of the sight pendulum 10 with respect to the mount plate 2 and the bow 42 in limited fashion and to limit downward extension of the pendulum bracket 11 past a predetermined point determined by the position of the pendulum bracket support 25 in the support pin slot 5, illustrated in FIG. 4 of the drawings.

As illustrated in FIG. 7, the fixed bow sight 31 is used in similar fashion, with no movement of the sight ring 16 with respect to the bow 42. The target reference marks 41 serve to facilitate approximation as to the range of the target when the target is positioned between the target reference marks and the horizontal crosshair 18, and may also be used in the pendulum bow sight 1.

While the preferred material for use as the crosshairs 18 is fluorescent monofilament line of selected color and diameter, it will be appreciated that other materials may also be used, as desired. The fluorescent monofilament line provides a superior viewing of the crosshairs 18, particularly under circumstances where the line is yellow, and when a black light source 39 is provided in the sight ring 16, on the pendulum bracket 11, the sight guard 38 or otherwise located to focus on the crosshairs 18, as heretofore described.

It will be appreciated by those skilled in the art that the fixed and pivoting bow sights of this invention can be utilized in bows of various design, but are particularly useful in compound bows, where the arrows are shot with great precision. The respective parts or elements of the fixed and pendulum bow sights may typically be constructed of easily moldable material, such as plastic.

While the preferred embodiments of the invention have been described above, it will be recognized and understood that various modifications may be made in the invention and the appended claims are intended to cover all such modifications which may fall within the spirit and scope of the invention.

Having described my invention with the particularity set forth above, what is claimed is:

1. A sight for a bow, comprising a mount plate for attachment to the bow; an elongated pendulum bracket pivotally attached to said mount plate, at substantially the longitudinal midpoint of said pendulum bracket; a sight ring fixed to said pendulum bracket at one end of said pendulum bracket, said sight ring disposed in a line-of-sight when the bow is positioned for use; monofilament crosshairs provided in said sight ring for viewing a target through said sight ring; a first counterweight provided on said pendulum bracket on one side of said midpoint and a second counterweight provided on said pendulum bracket on the other side of said midpoint of said pendulum bracket, whereby said pendulum bracket is substantially balanced on said mount plate at said substantially the midpoint of said pendulum bracket.

2. The sight of claim 1 wherein said monofilament crosshairs are characterized by at least one fluorescent color.

3. The sight of claim 1 comprising target reference marks provided on said sight ring in spaced relationship with respect to said monofilament crosshairs for alignment with said monofilament crosshairs on the target while aiming through said sight ring.

4. The sight of claim 1 comprising a source of black light mounted in said sight ring for illuminating said monofilament crosshairs with the black light.

5. The sight of claim 4 wherein said monofilament crosshairs are characterized by at least one fluorescent color.

6. The sight of claim 4 comprising target reference marks provided on said sight ring in spaced relationship with respect to said monofilament crosshairs for alignment with said monofilament crosshairs on the target while aiming through said sight ring.

7. The sight of claim 4 wherein said monofilament crosshairs are characterized by at least one fluorescent color and comprising target reference marks provided on said sight ring in spaced relationship with respect to said monofilament crosshairs for alignment with said monofilament crosshairs on the target while aiming through said sight ring.

8. The sight of claim 1 comprising a sight guard carried by said mount plate, said sight guard extending at least partially around said sight ring and a source of black light mounted on said sight guard for illuminating said monofilament crosshairs with the black light.

9. The sight of claim 8 comprising target reference marks provided on said sight ring in spaced relationship with respect to said monofilament crosshairs for alignment with said monofilament crosshairs on the target while aiming through said sight ring.

10. The sight of claim 9 wherein said monofilament crosshairs are characterized by at least one fluorescent color.

11. A sight for a bow, comprising a mount plate for attachment to the bow; a pendulum bracket pivotally attached to said mount plate; a sight ring attached to said pendulum bracket, said sight ring disposed in a line-of-sight when the bow is positioned for use and wherein said sight ring pivots with said pendulum bracket responsive to adjustment of the bow with respect to a target; monofilament crosshairs provided in said sight ring for viewing the target through said sight ring; and a stabilizing pin seat provided in said pendulum bracket and a stabilizing pin provided in said mount plate opposite said stabilizing pin seat, whereby said stabilizing pin is selectively extended through said mount plate into said stabilizing pin seat for preventing pivoting of said pendulum bracket and said sight ring in concert with respect to said mount plate.

12. The sight of claim 11 comprising a source of black light mounted in said sight ring for illuminating said monofilament crosshairs with the black light.

13. The sight of claim 11 comprising a sight guard carried by said mount plate, said sight guard extending at least partially around said sight ring and a source of black light mounted on said sight guard for illuminating said monofilament crosshairs with the black light.

14. The sight of claim 13 comprising:

(a) a stabilizing pin seat provided in said pendulum bracket and a stabilizing pin adjustably provided in said mount plate opposite said stabilizing pin seat, whereby said stabilizing pin is selectively extended into said stabilizing pin seat for preventing pivoting of said pendulum bracket and said sight ring in concert with respect to said mount plate; and (b) a pendulum bracket support adjustably provided in said mount plate opposite said pendulum bracket, whereby said pendulum bracket support is selectively extended into the path of pivot of said pendulum bracket to locate said pendulum bracket and said sight ring in a selected position with respect to said mount plate.

15. A sight for a bow, comprising a mount plate for attachment to the bow; a pendulum bracket pivotally attached to said mount plate; a sight ring attached to said pendulum bracket, said sight ring disposed in a line-of-sight when the bow is positioned for use and wherein said sight ring pivots with said pendulum bracket responsive to adjustment of the bow with respect to a target; monofilament crosshairs provided in said sight ring for viewing the target through said sight ring; and a pendulum bracket support provided in said mount plate opposite said pendulum bracket, whereby said pendulum bracket support is selectively extended into the path of pivot of said pendulum bracket to locate said pendulum bracket and said sight ring in a selected position with respect to said mount plate.

16. The sight of claim 15 comprising a stabilizing pin seat provided in said pendulum bracket and a stabilizing pin adjustably provided in said mount plate opposite said stabilizing pin seat, whereby said stabilizing pin is selectively extended into said stabilizing pin seat for preventing pivoting of said pendulum bracket and said sight ring in concert with respect to said mount plate.

17. The sight of claim 16 comprising a source of black light mounted in said sight ring for illuminating said monofilament crosshairs with the black light.

18. The pendulum bow sight of claim 16 wherein said crosshairs are fluorescent monofilament crosshairs and comprising a source of black light mounted in said pendulum bracket for illuminating said crosshairs with the black light.

19. A pendulum bow sight for a bow, comprising a mount plate carried by the bow; a pendulum bracket pivotally carried by said mount plate; a sight ring provided on said pendulum bracket, said sight ring disposed in a line of sight when the bow is positioned for use; a stabilizing pin seat provided in said pendulum bracket and a stabilizing pin adjustable provided in said mount plate opposite said stabilizing pin seat, whereby said stabilizing pin is selectively extended into said stabilizing pin seat for preventing pivoting of said pendulum bracket and said sight ring in concert with respect to said mount plate; a pendulum bracket support adjustably provided in said mount plate opposite said pendulum bracket, whereby said pendulum bracket support is selectively extended into the path of pivot of said pendulum bracket to locate said pendulum bracket and said sight ring in a selected position with respect to said mount plate; and crosshairs of selected size and color provided in said sight ring for viewing a target through said sight ring.

20. The pendulum bow sight of claim 19 wherein said crosshairs are fluorescent monofilament crosshairs and comprising a source of black light mounted in said sight ring for illuminating said crosshairs with the black light.

21. The sight of claim 19 comprising a sight guard carried by said mount plate said sight guard extending at least partially around said sight ring and a source of black light mounted on said guard for illuminating said monofilament crosshairs with the black light.

22. The sight of claim 21 comprising:

(a) a stabilizing pin seat provided in said pendulum bracket and a stabilizing pin adjustably provided in said mount plate opposite said stabilizing pin seat, whereby said stabilizing pin is selectively extended into said stabilizing pin seat for preventing pivoting of said pendulum bracket and said sight ring in concert with respect to said mount plate; and (b) a pendulum bracket support adjustably provided in said mount plate opposite said pendulum bracket, whereby said pendulum bracket support is selectively extended into the path of pivot of said pendulum bracket to locate said pendulum bracket and said sight ring in a selected position with respect to said mount plate.

23. A pendulum bow sight for attachment to a bow having a sight guard, said pendulum bow sight comprising a mount plate attached to the bow; a pendulum bracket pivotally attached to said mount plate; a round sight ring fixedly carried by said pendulum bracket, said sight ring disposed in a line of sight when the bow is positioned for use; fluorescent monofilament crosshairs provided in said sight ring for viewing a target through said sight ring; a source of black light mounted on the sight guard for illuminating,said crosshairs with the black light; a stabilizing pin seat provided in said pendulum bracket and a stabilizing pin adjustably provided in said mount plate opposite said stabilizing pin seat, whereby said stabilizing pin is selectively extended through said mount plate into said stabilizing pin seat for preventing pivoting of said pendulum bracket and said sight ring in concert with respect to said mount plate; and a pendulum bracket support adjustably provided in said mount plate opposite said pendulum bracket, whereby said pendulum bracket support is selectively extended into the path of pivot of said pendulum bracket to locate said pendulum bracket and said sight ring in a selected position with respect to said mount plate.

* * * * *